United States Patent [19]

Babunovic et al.

[11] 4,044,783

[45] Aug. 30, 1977

[54] LABEL REMOVAL APPARATUS FOR CONTAINER WASHING MACHINES

[75] Inventors: Momir Babunovic, Des Peres; Donald E. Whitlock, Creve Coeur, both of Mo.

[73] Assignee: Barry-Wehmiller Company, St. Louis, Mo.

[21] Appl. No.: 669,043

[22] Filed: Mar. 22, 1976

[51] Int. Cl.[2] ..... B08B 3/04; B08B 9/08

[52] U.S. Cl. ..... 134/73; 134/104; 134/154

[58] Field of Search ..... 134/73–75, 134/83, 104, 130, 154, 182–183

[56] References Cited

U.S. PATENT DOCUMENTS 3,162,204 12/1964 Babunovic et al. ..... 134/74

3,868,960 3/1975 Cove et al. ..... 134/73

FOREIGN PATENT DOCUMENTS 1,090,784 4/1955 France ..... 134/130

*Primary Examiner*—Robert L. Bleutge

*Attorney, Agent, or Firm*—Gravely, Lieder & Woodruff

[57] ABSTRACT

Container washing apparatus arranged for controlling the handling of the labels as they detach from the containers and for collecting the labels in spaced zones which are in communication through a system of transfer passages and baffles so that fluid flow directing nozzles will be effective to move the labels in an orderly and substantially non-turbulent manner to an outlet connected to apparatus for separating out the labels and returning the washing solution for reuse.

11 Claims, 7 Drawing Figures

LABEL REMOVAL APPARATUS FOR CONTAINER WASHING MACHINES

BACKGROUND OF THE INVENTION

This invention relates to label removal apparatus for container washing machines, and particularly to such apparatus for handling labels normally pasted or glued on containers and which must be removed before reuse of the containers.

The present invention is an improvement over container washing apparatus earlier disclosed in U.S. application Ser. No. 605,279, filed Aug. 18, 1975, and assigned in common with this application.

Washing apparatus having known characteristics is disclosed in U.S. Pat. No. 3,162,204, issued Dec. 22, 1964, and assigned in common with this application. In that patent the apparatus conducted containers through several compartments containing hot caustic solution which penetrated the labels and the adhesive and caused the labels to become detached. That apparatus provided one or more troughs, each within the path of travel of the container carriers, for the purpose of accumulating the majority of detached labels and reducing the quantity of lables settling on the bottom of the compartments. Forced fluid circulating means provided in the compartment bottoms and in the troughs operated substantially continuously to remove the accumulation of labels before they could settle and pack, and become difficult to remove.

Another machine for washing bottles has been disclosed in U.S. Pat. No. 3,868,960, issued Mar. 4, 1975, and concerns means for removing labels after becoming detached from the containers. In that apparatus the containers are conducted through one or more soaker compartments where the labels are subjected to a washing solution. However, labels are not permitted to escape from the container carrier pockets until the containers have reached a prepared zone where fluid jets flush the labels out of the pockets and off the containers. The detached labels have a high rate of accumulation in a limited capacity zone of that apparatus, and the zone is equipped with fluid circulation nozzles set up to induce label movement out of the machine.

BRIEF SUMMARY OF THE INVENTION

The present washing apparatus is principally adapted for use in connection with the washing of containers for reuse, and wherein such containers brought to the washer are found to be carrying paper or metallic label material that is applied by a suitable adhesive. It is normal in washing apparatus of this character to insert the containers into individual pockets, which pockets are arranged in carriers that may be 40 to 60 pockets wide. The containers are continuously moved through several compartments containing hot caustic solution which is intended to remove foreign matter from the interior as well as to penetrate the label material so as to soften the adhesive and thereby cause the labels to become detached. The detached labels are permitted to exit from the carrier pockets as soon as possible and descend toward a unique arrangement of collecting means above the bottom of the compartments where fluid jets become useful in causing the descending labels to be propelled toward outlets.

A difficulty with the operation of prior container washing apparatus is that the specific gravity of the labels after being subjected to the caustic solution very nearly equals the specific gravity of the washing solution itself. Since the specific gravity of the labels and the washing solution is nearly equal, the labels have a tendency to float or become quite boyant, thereby making the labels particularly sensitive to very low velocity movement of or turbulence in the washing solution. In the operation of many container washing machine, labels have been found to move in uncontrolled patterns and move into areas where they can be reapplied to the containers. That problem is overcome in the manner herein disclosed.

It is a particularly important object of this invention to provide means in one or more compartments of washing apparatus to control the movement of the labels after they become detached so as to prevent the labels from reapplying themselves to the containers by preventing the labels being carried into areas of the washer where they are not desired.

It is a further important object of the present invention to provide means which will encourage the movement of labels away from the path of movement of the bottle carrier pockets and to avoid stimulating the boyant characteristics of labels, which stimulation causes them to remain in suspension or move upwardly into areas where they can interfere with other operations.

Yet another object of the present invention is to provide means working in cooperation with fluid flow directing jets to cause label travel into areas of the compartments where confining means can prevent the labels floating into unwanted areas and can suppress turbulence of the washing solution.

In a preferred form of the present invention, the container washing apparatus is divided into a plurality of compartments containing means which act as baffles, such that as the labels soften and are flushed from the containers they are cuased to move into spaces where the baffles and fluid flow directing nozzles cooperate to cause the labels to move in a controlled pattern which is ultimately effective to direct the labels toward suction outlets.

The preferred embodiment of baffles and fluid circulating nozzles functions so as not to upset the orderly descent of detached labels from the upper areas of the compartments, as misdirected fluid flow and eddy currents set up thereby can result in propelling labels in unwanted directions to positions where they can become plastered on the carrier pockets and containers and be transported into compartments of the apparatus where the labels are distinctly not wanted.

The objects and advantages of the present invention will be set forth in connection with the following description in which the various components of the apparatus will be described in detail.

BRIEF DESCRIPTION OF THE DRAWINGS

The apparatus of this invention is set forth in relation to presently preferred embodiments in the accompanying drawings, wherein.

DETAILED DESCRIPTION OF THE EMBODIMENT

Figure 1:
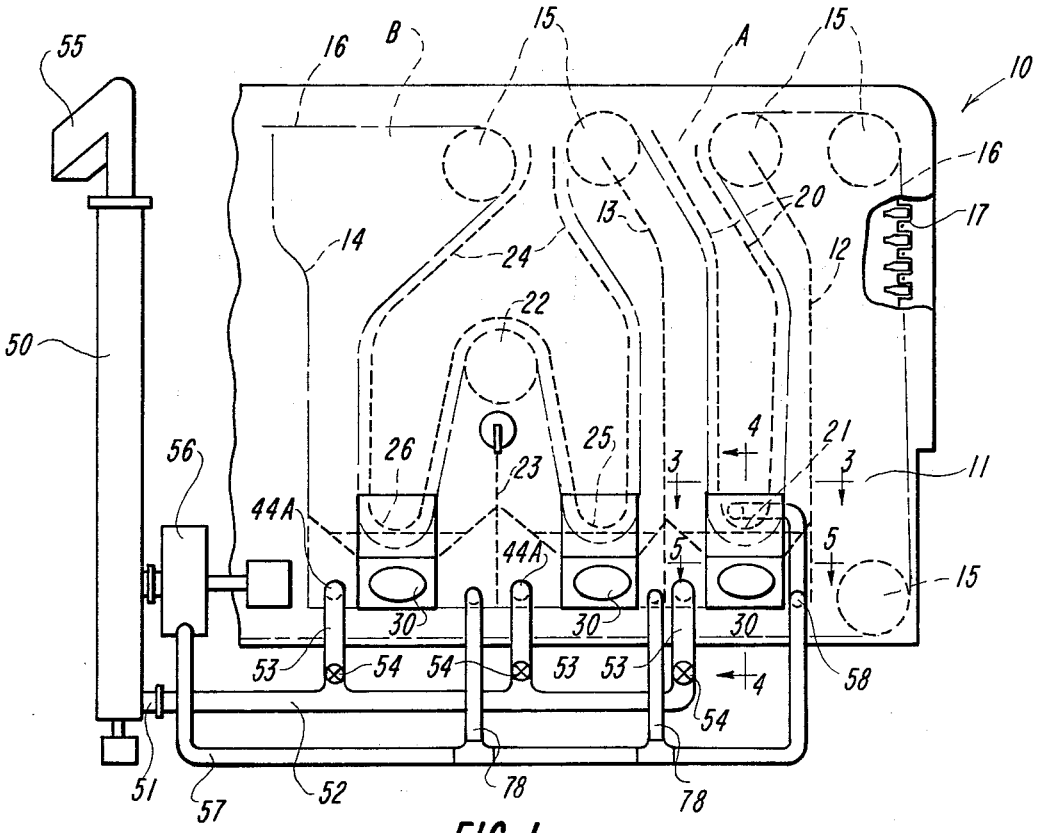
FIG. 1 is a side elevational view of so much of the container washing apparatus and fluid circulating system as will serve to convey an understanding of the present invention.
Figure 7:
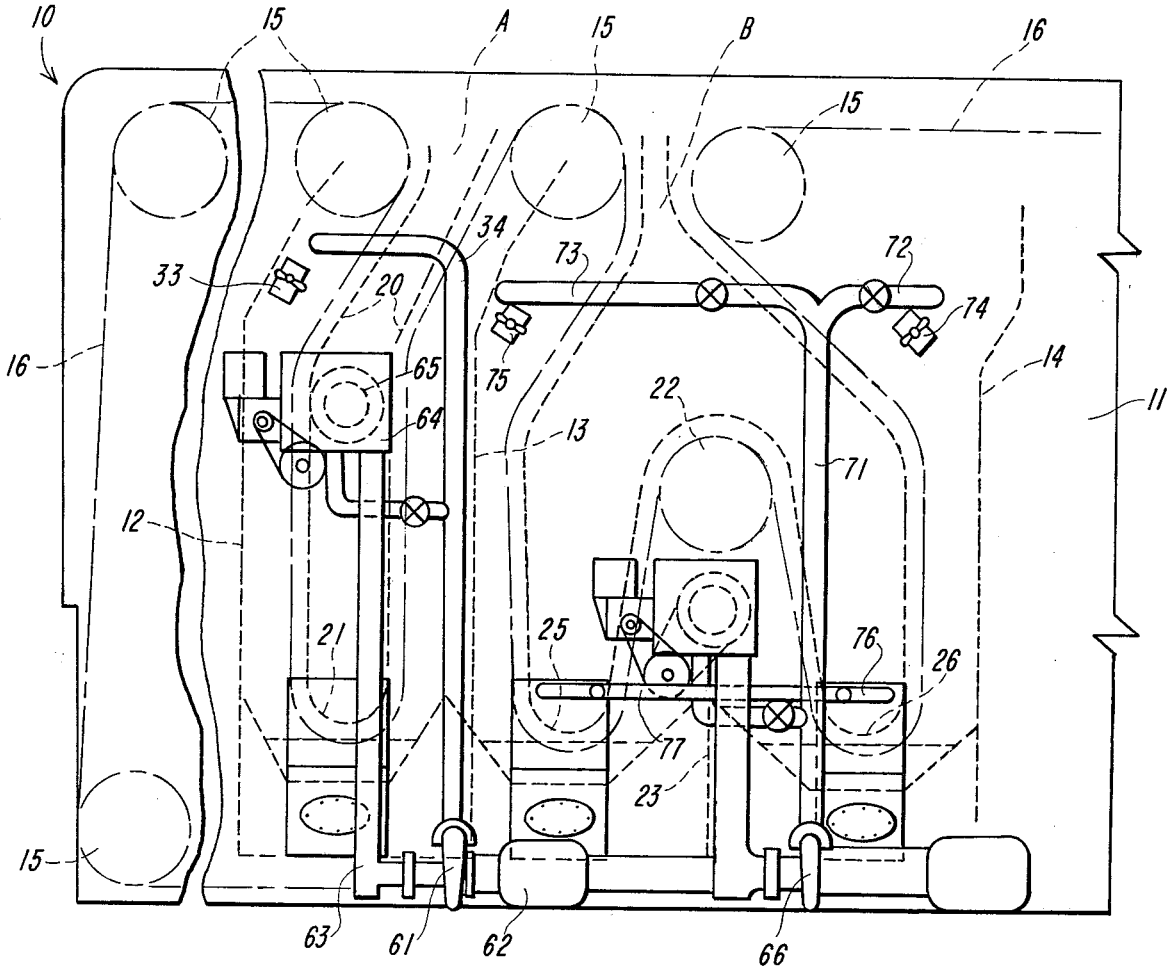
FIG. 7 is a fragmentary side view of the side opposite to FIG. 1 showing the fluid circulating system associated with that side of the machine.

The general exterior view of the container washer 10 is seen in fragmentary side elevation in FIG. 1 with the container infeed end at the right, and the opposite side is seen in FIG. 7 with the infeed at the left. Generally the washer apparatus is enclosed between elongated side walls 11, while individual compartments A and B are separated by walls which are shown in broken line at 12, 13 and 14. A conveyor mechanism is directed through the apparatus in an endless manner on appropriate sprockets 15 carried by the side walls 11 and which support and drive the conveyor chain depicted by its pitch line 16. The chain 16 is spaced apart within the width of the side walls 11 as is usual in this apparatus. The carriers (FIG. 3) for the containers are elongated frames 17 extending between the chain 16 and each frame is provided with open-ended pockets 18 for the containers. The containers are usually fed into the pockets open end first. As the chain moves the carriers through the several compartments (only two being shown) the containers are emersed in washing solution which may be hot caustic of a strength to penetrate the dirt and trash inside and to loosen the adhesive used to apply the labels to the exterior, thereby cleaning and sterilizing the containers at the same time.

Figure 2:
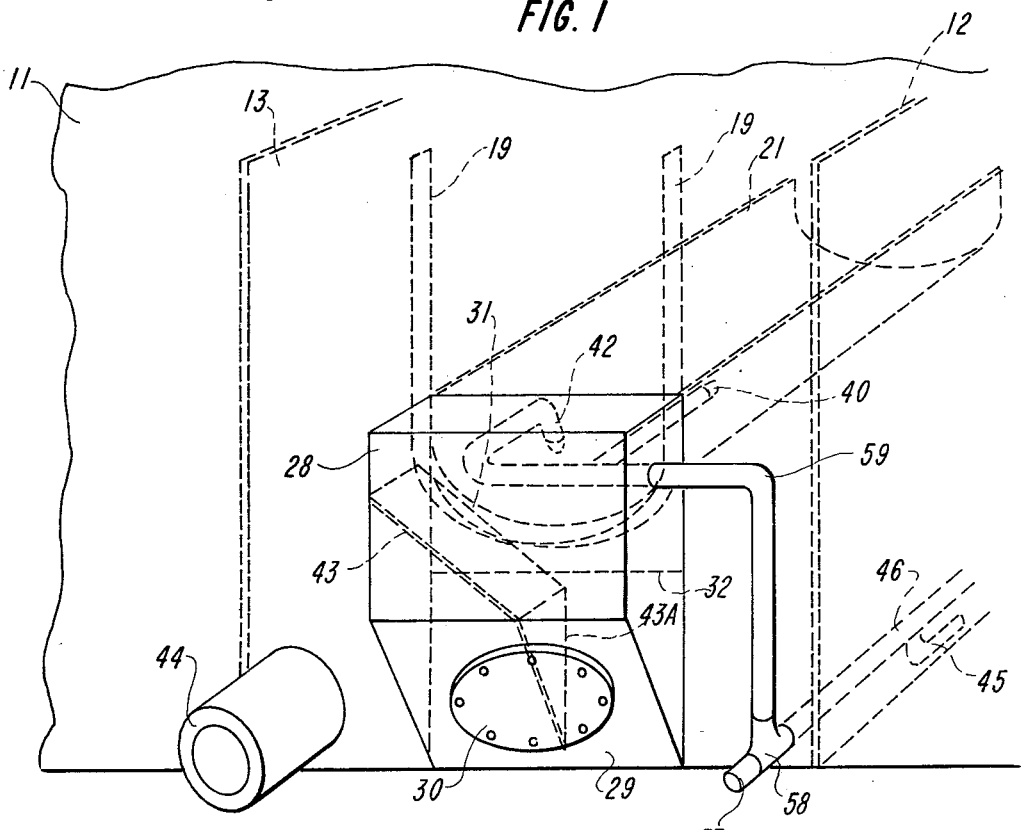
FIG. 2 is a fragmentary perspective view of an exterior portion of the washing apparatus shown in FIG. 1 particularly showing a transfer passage for moving labels from a higher accumulating zone to a lower zone.
Figure 3:
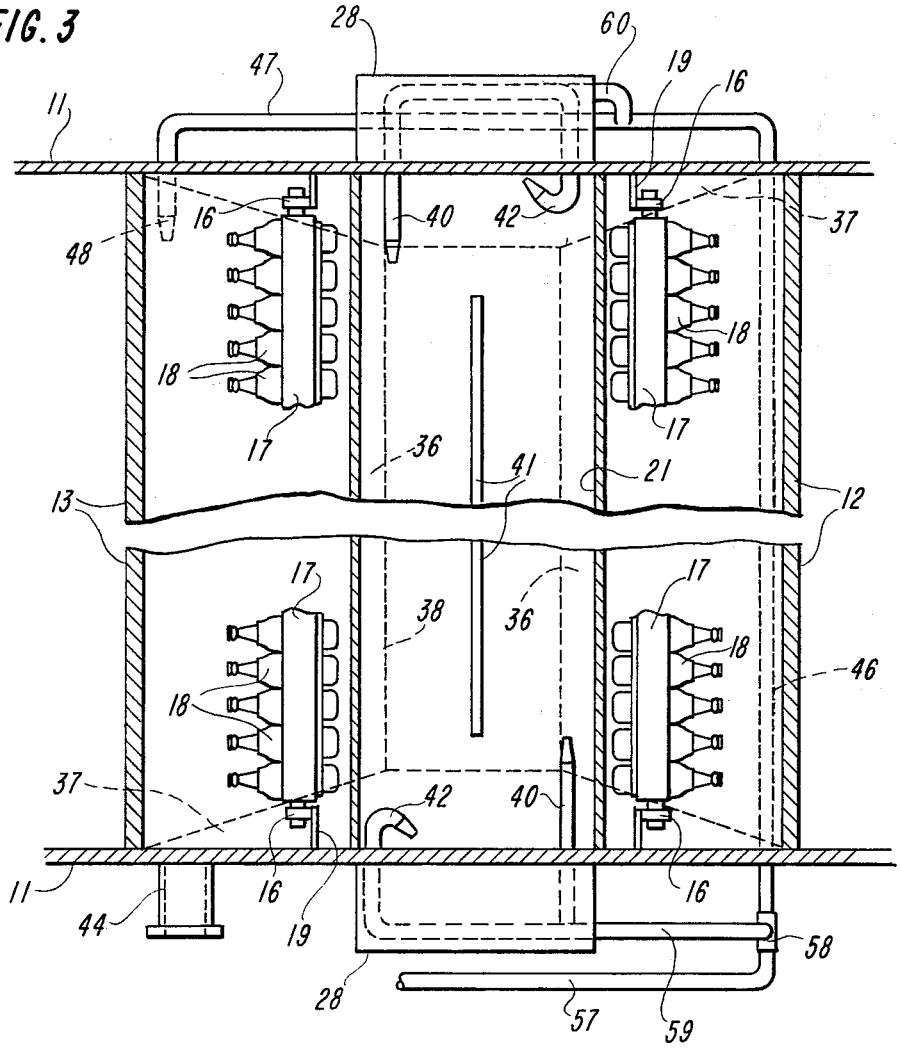
FIG. 3 is a fragmentary plan view, partly in section, showing a typical trough accumulating zone seen at line 3—3 in FIG. 1.

The containers enter the first shown compartment A from the open top formed between the side walls 11 and the transverse walls 12 and 13. The path of the conveyor chain 16 is defined by tracks 19 (FIGS. 2 and 3) which have a path matching the contour of means retaining the containers in the carriers, such as spaced bars or, or as shown, guide sheets 20. The sheets 20 extend to a bottom return loop which forms a trough 21 inside the descending and the ascending portions of the sheets (FIGS. 2 and 3). The guide sheets separate the trough and the space above it from the space in the compartment A on the outside of the sheet.

The carriers 17 leave the first compartment A and traverses the next upper sprocket 15 to enter compartment B from its open top over the wall 13. This latter compartment is formed between the transverse walls 13 and 14 and due to the intermediate sprocket 22 being disposed below the upper sprockets 15, an intermediate low wall 23 is located under the sprocket 22 for a purpose later to be noted. The conveyor chain 16 in compartment B follows a track (not shown) which has the same contour as the guide sheets 24, although bars may be employed as noted above. The sheets 24 are directed into a first loop trough 25 ahead of the sprocket 22 and a second loop trough 26 behind sprocket 22, all as indicated in FIGS. 1 and 7. It can be seen in these views that the conveyor chain 16 leaves compartment B by passing over the upper sprocket 15 and continuing beyond the transverse wall 14. Since this disclosure is concerned principally with label removal it will not be necessary to show or describe a complete washing machine, except to note that the conveyor chain and the empty carriers 17 will return in the space below the compartments A and B and move around the lower most sprocket 15 to the starting point.

Figure 4:
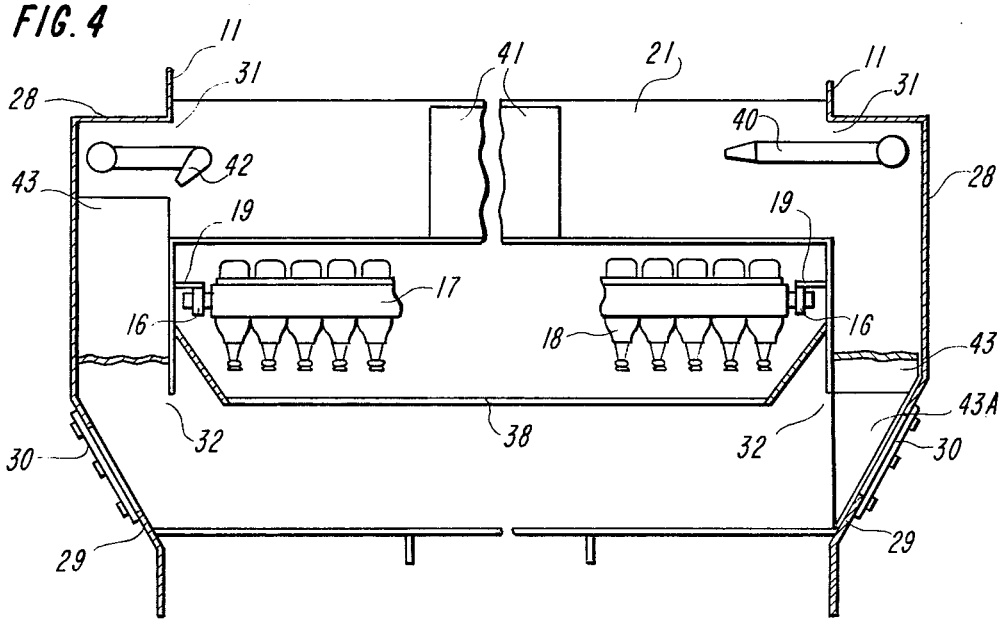
FIG. 4 is a fragmentary view, partly in section, showing a typical baffle assembly seen at line 4—4 in FIG. 1.
Figure 6:
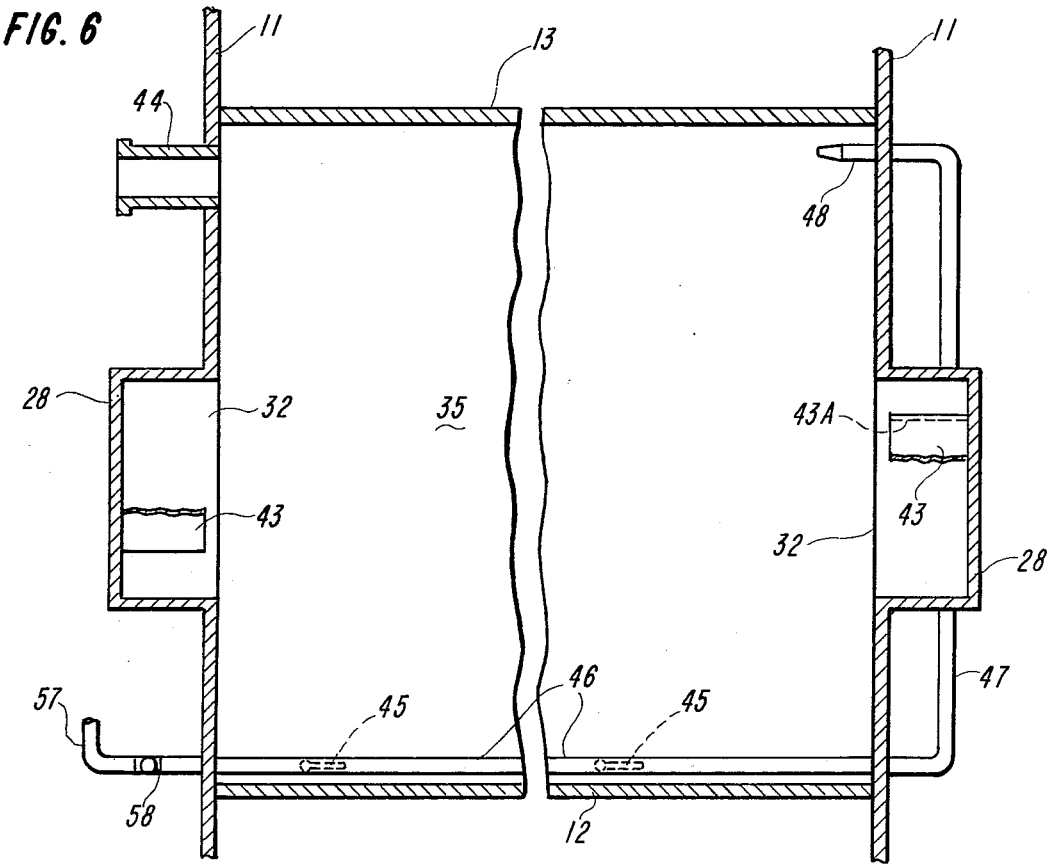
FIG. 6 is a further fragmentary plan view, partly in section, of the bottom discharge zone seen at line 6—6 in FIG. 1.

Turning now to FIGS. 2 and 3 it can be seen that the opposite side walls 11 support projecting transfer passage forming means 28 each of which is formed as a rectangular box having a tapered lower portion 29 equipped with an access opening covered by a removal manhole cover 30. The transfer passages are associated with the several troughs 21, 25 and 26 (FIGS. 1 and 7) and a description of one thereof is believed to be sufficient for an understanding of all. As shown in FIGS. 2 and 4 the opposite ends of the trough 21 are open into the upper portion of the transfer passage 28 through a semicircular opening 31 formed in the side walls 11. The lower portion 29 of each transfer passage opens into the bottom of compartment A through a rectangular opening 32 (FIG. 6). The path of travel of the conveyor chains 16 follows the fixed track 19 so that, as shown in FIGS. 3 and 4, the containers pass around the curved underside of the trough 21. As indicated in FIG. 3, the right hand carrier 17 of FIG. 3 is descending while the left hand carrier 17 is ascending. The labels are flushed from the carriers 17 by a flushing nozzle device 33 supplied from a conduit 34 (FIG. 7). The flushing nozzle 33 is part of apparatus described and claimed in said co-pending application Ser. No. 605,279, filed Aug. 18, 1975, and having a common assignee with the present application. The nozzle device 33 causes labels to be flushed off of the containers and out of the carriers 17 into the space (FIGS. 1 and 7) between the guide means 20. Thus, the detaching labels are directed to fall into the trough 21 by the guide means 20, thereby not dispersing throughout the compartment A.

Figure 5:
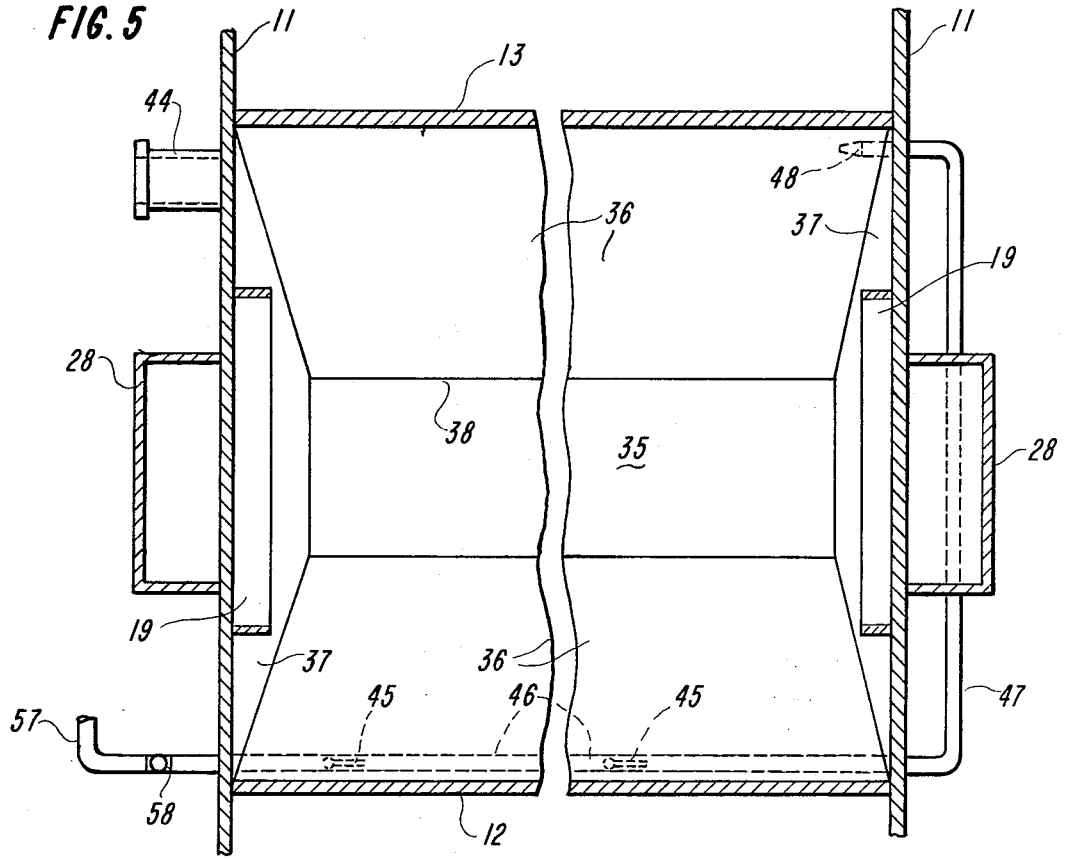
FIG. 5 is a further fragmentary plan view, partly in section, of a baffle assembly for label collecting and control of movement to a discharge zone seen at line 5—5 in FIG. 1.

As shown in FIGS. 3, 4 and 5, the transfer passages 28 permit communication between the opposite ends of the trough 21 and a bottom space 35 to which the lower openings 32 of the transfer passages open. Between the bottom of the trough 21 and the bottom space 35 of compartment A is disposed an assembly of baffles which, as seen best in FIG. 5, comprise longitudinal baffle plates 36 which extend between the side walls 11 and end baffle plates 37 which extend parallel to the side walls 11 and abut with the ends of the baffle plates 36. The several baffle plates are secured so as to slant downwardly toward a central opening 38 spaced below the trough 21 and in position to permit the descent of labels that may be late in detaching after the carriers 17 pass below the trough 21 (FIG. 4).

The foregoing description of the label handling means for compartment A is duplicated with necessary modifications in compartment B, and the baffle system above described is associated with troughs 25 and 26 as indicated in FIGS. 1 and 7 by the dotted line showing of baffles 36 and 37. It is not believed necessary to show or describe the baffle system for compartment B in view of the understanding to be obtained from the detailed description for the baffle system of compartment A.

It is an important feature of the present apparatus to continually move the accumulating labels from the trough 21 through opening 31 to the transfer passages 28 and through the bottom openings 32 into the space 35 below the trough 21 and baffle plates 36 and 37. This transfer of accumulated labels through the transfer passages 28 is accomplished by supplying fluid under pressure to a pair of first circulating nozzles 40 which are located at the opposite ends of trough 21 and are in offset relation so as to set up a generally horizontal circulation of labels and caustic washing solution around a baffle plate 41 which extends longitudinally of trough 21 and has a vertical dimension at least equal to the depth of trough 21 (FIG. 4). It is critical to the nonturbulent transfer of accumulated labels from the trough 21 through the semi-circular opening 31 at the opposite ends and into the to provide transfer passages 28, not only nozzles 40 but a second pair of offset nozzles 42 disposed adjacent the opening 31 to induce flow of caustic solution angularly downwardly into the transfer pasages 28. The angular setting of the nozzles 42 can be seen in FIGS. 2, 3 and 4. Non-turbulent flow initiated by the nozzles 42 is assured by the placement in each of the transfer passages 28 of an angular deflector plate 43 having a depending fin 43A at its lower end. The deflector plates are secured in the transfer passages 28 in angular positions (FIG. 2) so as to compliment the angular flow path initiated by the nozzles 42. The deflector plates 43 extend downwardly so that the fins 43A at the lower ends thereof begin substantially at the level with the upper margin of the openings 32 into the bottom space 35. This positioning and sizing of the deflector plates 43 is critical to the non-turbulent flow of labels and greatly improves the ability to cause the labels to flow into the bottom space 35 and remain below the baffle plates 36 and 37. While not specifically shown, the portion of the fins 43A which pass adjacent the removable manhole covers 30 can be attached to the covers so that on cover removal that portion will be removed to not obstruct entry, when necessary, of a service person.

Turning now to FIGS. 5 and 6 it can be seen that a second set of nozzles is provided in the bottom space 35 for maintaining a horizontal circular movement of the labels toward an outlet fitting 44. This set of nozzles includes a first pair 45 depending from and supplied by a common pipe 46 which extends along side the transverse wall 12 of compartment A. Pipe 46 passes through the side wall 11 to an exterior pipe 47 which extends under the transfer passage 28 and reenters the space 35 adjacent wall 13 where it connects with a single nozzle 48.

In the present apparatus the fluid supplying all of the nozzles shown in FIG. 3 is obtained from a separator device 50 (FIG. 1) which has an inlet 51 connected by conduit 52 to branch conduits 53 which are connected respectively to the outlet 44 from the bottom of compartment A, as well as outlets 44A from the bottom of compartment B on opposite sides of the intermediate wall 23. Each of the branch conduits 53 is provided with a control valve 54 so that the removal of labels may be alternately effected through the branch conduits 53. This alternation can be coordinated with the rate of label accumulation in the bottom of the compartments A and B. The separator device 50 is shown and described in U.S. Pat. No. 3,322,283, issued May 30, 1967, and its structure and function is incorporated herein by reference to that patent for the purpose of understanding that the separator 50 functions to extract the labels from the caustic solution and discharge the labels through the upper shute 55, while the clean caustic solution is returned by pump 56 through an outlet pipe 57 to a suitable connection 58. The caustic solution from connection 58 is supplied to the pipe 46 in the bottom of compartment A and a portion of the solution is supplied to pipe 59 for connection to the respective nozzles 40 and 42 in trough 21. There is a second pipe 60 on the opposite side of compartment A (FIG. 3) which feeds the nozzles 40 and 42 adjacent opposite side wall 11 from the pipe 47. Thus, the cleaned caustic solution is returned from the separator device 50 by pump 56 to supply all of the nozzles for compartment A shown in FIG. 3.

Turning now to FIG. 7, it can be seen that the supply pipe 34 for the flushing nozzle device 33 is connected to pump 61 driven by motor 62, and the pump 61 has its suction conduit 63 connected into the outlet box 64 associated with a rotary screen 65 which has been shown and described in the aforementioned co-pending application, Ser. No. 605,279. The outlet of pump 66 is directed by conduit 71 to conduits 72 and 73 respectively associated with flushing nozzle devices 74 and 75. A first branch conduit 76 from the main conduit 71 is connected to nozzles in the trough 26 which while not shown are equivalent to the foregoing described nozzles 40 and 42 shown in FIG. 3. A second branch conduit 77 from conduit 71 is connected to nozzles associated with the trough 25, such nozzles not being specifically shown or described but are equivalent to nozzles 40 and 42 seen in FIG. 3. FIG. 1 shows that the nozzle means for the bottom spaces below troughs 35 and 26 in compartment B are connected to branch pipes 78.

While the transfer passages 28 have the width as shown in FIGS. 2 and 6, it is within the scope of the passage size to make them wider so that the opening 32 into the bottom of the compartment A is extended closer to the transverse wall 12 so that the deflector fin 43A can be moved into the plane of the deflector 43 and act to direct the flow of fluid and labels further into the corner below the baffles 36 and 37 where the horizontal circulating effect of the nozzles 45 will have even more effect to prevent the labels from reaching the opening 38 (FIG. 5) and possibly being caused to rise through that opening.

The foregoing description has set forth the characteristics of label removing apparatus for washing machines for containers bearing removable labels, and has particularly set forth means for removing the detached labels from the machine by the circulation of the caustic washing solution internally of the washing machine and externally thereof in association with means for separating the labels from the caustic washing solution prior to is reuse. It has been pointed out that the label removal apparatus is associated with one or more compartments in the washing machine and is operatively disposed in an upper label collecting trough and in a lower label collecting space at the bottom of the compartment so that the action of washing solution flow directing nozzles can effect transfer of the accumulating labels from the trough to the compartment between space and then to the exterior of the washing machine. It is particularly critical to the operation of the label removing apparatus to avoid causing turbulence in the washing solution as such turbulence will violently disturb the movement of labels and increase the difficulty of getting labels to move to the lower zone as rapidly as possible. The difficulty is particularly due to the fact that labels subjected to the caustic washing solution reach a substantially similar specific gravity condition. Control over the suppression of turbulence is obtained by the herein about described use of flow directing nozzles and in the placement of a system of baffle plates in the compartment bottom space and deflector plates in the transfer passages which are located externally of the washing machine side walls but have communication with the troughs and with the bottom space.

What is claimed is:

1. Label removal apparatus for washing machines for containers bearing removable labels and for removing the detached labels from the machine, comprising: a washing solution containing compartment formed by and between side walls and walls transverse to said side walls; guide means extending downwardly in said compartment; label collecting trough means connected to said guide means and spaced above the bottom of said compartment, said guide means directing labels into said trough means, container conveying means movable through said compartment in descending and ascending paths outside of said guide means so as to have a path of travel beneath said trough means from the descending path to the descending path; an assembly of baffle means spaced below the path of travel of said conveyor means and above the compartment bottom to define a bottom space below said trough means; washing solution and label transfer passage means forming a communication between said trough means and said bottom space; fluid directing nozzle means in said trough means adjacent said transfer passage means to create a flow current for moving washing solution burdened with labels from said trough through said transfer passage means into said bottom space, and outlet means for washing solution burdened with labels connected into said bottom space.

2. The label removal apparatus of claim 1 wherein said baffle means includes plates projecting from said side and transverse walls to positions below said trough means, said plates forming an opening between said bottom space and the underside of said trough.

3. The contaner washing apparatus set forth in claim 2 wherein said washing solution flow directing means in said trough are disposed adjacent said passage forming means and include washing solution nozzles the discharge from which is directed partially into said passage forming means to move labels into the bottom of the compartment.

4. The container washing apparatus set forth in claim 2 wherein said baffle means is disposed below said trough and extends lengthwise thereof between said passage forming means, said baffle means being open in an area thereof underneath said trough to direct labels from outside of said trough into the compartment bottom.

5. The label removal apparatus of claim 1 wherein deflector means is positioned in said transfer passage means to cooperate with said nozzle means in said trough means and suppress turbulence.

6. The label removal apparatus of claim 1 wherein separator means is connected to said outlet means to receive washing solution burdened with labels and separate out the labels, and conduit means is connected between said separator means and said nozzle means to return washing solution freed of labels.

7. The label removal apparatus of claim 1 wherein said transfer passage means has communication between the opposite ends of said trough means and said bottom space through said side walls, and nozzle flow deflector means is positioned in each of said transfer passage means.

8. Label removal apparatus set forth in claim 1, wherein said trough means extends between said side walls; said transfer passage means are located outside each of said side walls and each communicates through said side walls with the adjacent end of said trough means and with said bottom space; said fluid directing nozzle means is located adjacent each of said transfer passage means and is directed toward the opposite transfer passage means to create opposed currents; and baffle means is disposed in said trough means in position to separate the opposed currents of washing solution burdened with labels created by said fluid directing nozzle means.

9. The label removal apparatus of claim 1 wherein said trough means communicates at its opposite ends with said transfer passage means; said nozzle means includes nozzles directed from adjacent one transfer passage means toward the transfer passage means at the opposite end of said trough means, and baffle means is disposed in said trough means in position to separate the currents of washing solution burdened with labels, whereby turbulence in the washing solution is suppressed.

10. Label removal apparatus for washing machines for containers bearing adhesively applied labels and for removing the labels from the containers and from the apparatus, comprising: at least one washing solution containing compartment open at the top, closed at the bottom and defined between side and transverse walls of said machine; container conveyor means following a path extending downwardly into said compartment from the top thereof and having a return path after forming a bottom loop above the compartment bottom, said conveyor including track means, chains following said track means, and container carriers having open ended pockets to receive the containers; guide means extending along said conveyor track means and around the return bottom loop and forming a label collecting trough in the bottom loop; transfer passage means opening between said bottom loop label collecting trough and the bottom of said compartment; an outlet for washing solution and entrained labels from the bottom of said compartment; washing solution flow directing means in said label collecting trough and in said compartment bottom below said trough, said washing solution flow directing means in said collection trough flushing the labels accumulating in said trough through said transfer passage means toward said compartment bottom through said transfer passage means, and baffle means adjacent said trough and passage forming means, said flow directing means in said compartment below said baffle means flushing the labels toward and into said compartment outlet and said baffle means being in position to substantially suppress the washing solution currents from rising above said compartment bottom and thereby reducing the migration of labels away from the area of said compartment bottom and said compartment outlet.

11. The container washing apparatus set forth in claim 10 wherein said container carriers are each elongated to support a plurality of containers, said label collecting trough is elongated to substantially match said carrier elongation, and said passage forming means are disposed at the opposite ends of said elongated label collecting trough to open from the trough ends into said compartment bottom.

* * * * *

UNITED STATES PATENT OFFICE

CERTIFICATE OF CORRECTION

Patent No. 4,044,783 Dated August 30, 1977

Inventor(s) Momir Babunovic and Donald E. Whitlock

It is certified that error appears in the above-identified patent and that said Letters Patent are hereby corrected as shown below:

Column 2, line 37 "cuased" should be "caused".

Column 5, line 13 "into the to provide transfer passages 28," should read "into the transfer passages 28, to provide".

Column 7, line 17 after "means" should be a semi-colon instead of a comma.

Column 7, line 21 "descending" should be "ascending".

Column 7, line 32 after "space" should be a semi-colon instead of a comma.

Column 8, line 21 after "means" should be a semi-colon instead of a comma.

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*